United States Patent [19]

Peterson

[11] 4,228,547

[45] Oct. 21, 1980

[54] REINFORCED CLOTHING COMPONENT AND METHOD OF MAKING SAME

[76] Inventor: Paul G. Peterson, 52 Bruce St., Kitchener, Ontario, Canada, N2B 1Y5

[21] Appl. No.: 7,770

[22] Filed: Jan. 30, 1979

Related U.S. Application Data

[63] Continuation of Ser. No. 747,957, Dec. 6, 1976, abandoned.

[51] Int. Cl.[2] ..... A41B 3/00

[52] U.S. Cl. ..... 2/129

[58] Field of Search ..... 2/129, 243 R, 143, 132

[56] References Cited

U.S. PATENT DOCUMENTS

| | | | |
|---|---|---|---|
| 2,719,803 | 10/1955 | Nottebohm | 2/143 |
| 3,363,263 | 11/1968 | Blue | 2/132 |
| 3,504,378 | 4/1970 | Teperson | 2/143 |

*Primary Examiner*—Werner H. Schroeder
*Assistant Examiner*—Doris L. Troutman
*Attorney, Agent, or Firm*—Diller, Ramik & Wight

[57] ABSTRACT

This disclosure has to do with the stiffening of clothing components, such as collars, cuffs, etc. which, in the past, has been effected by means of separately formed stiffening elements. In lieu of providing a separately formed stiffening element which must be separately incorporated within the clothing part, it is proposed to provide a component of the clothing part with a coating of thermoplastics material which is applied in a preselected pattern to provide the desired stiffness. This eliminates the necessity of separately formed elements which, in turn, eliminates the necessity of maintaining a supply of such elements and the separate incorporation thereof in a clothing part.

9 Claims, 5 Drawing Figures

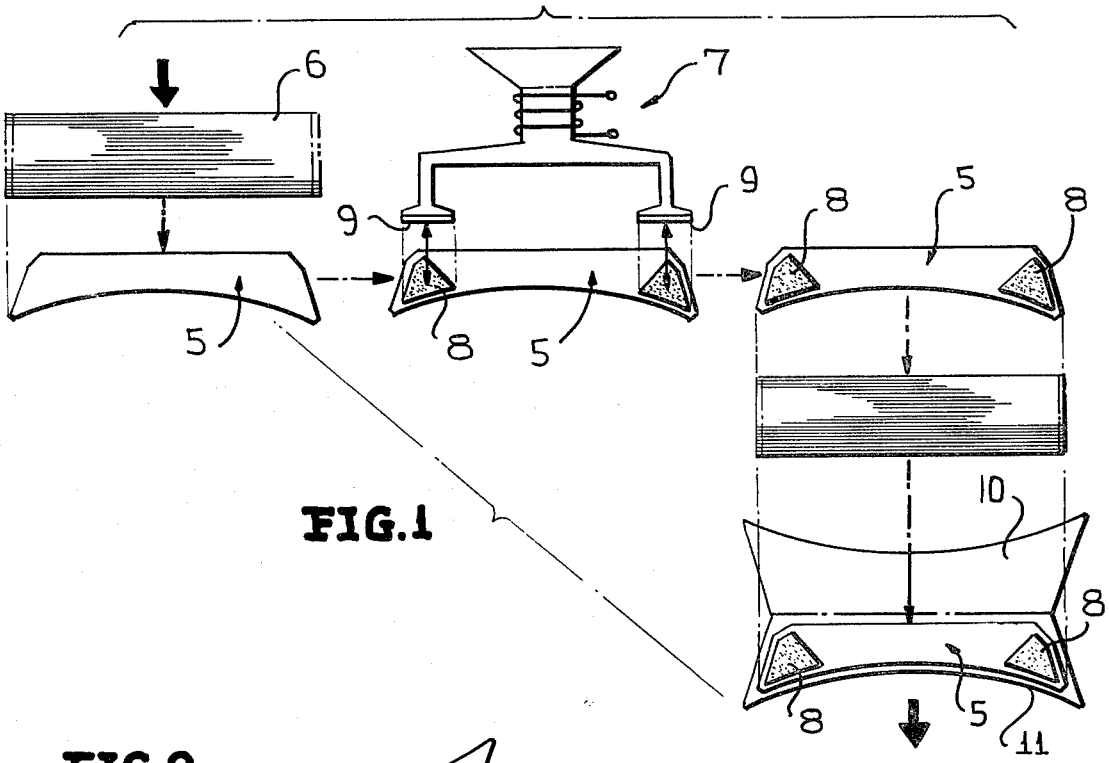
FIG.1
FIG.2
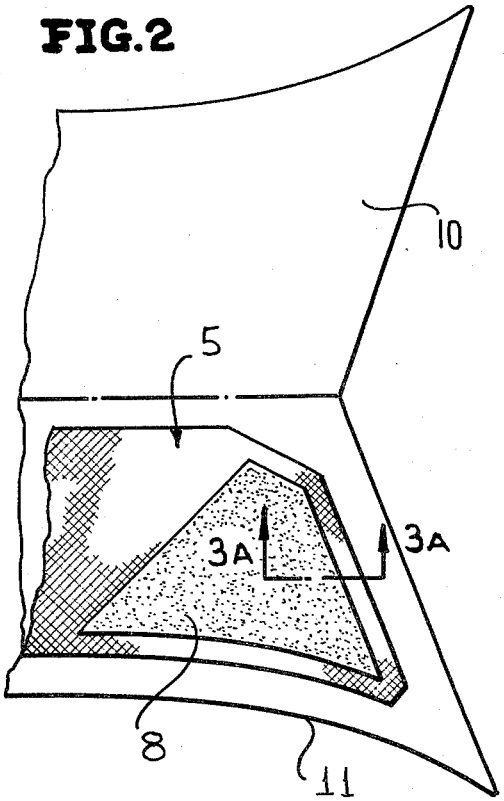
FIG.3A
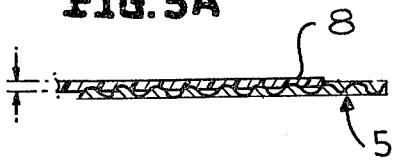
FIG.3B
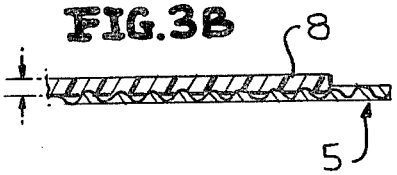
FIG.4
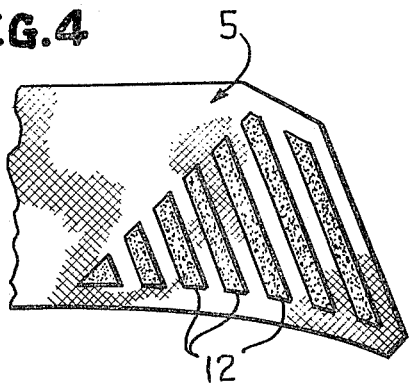

REINFORCED CLOTHING COMPONENT AND METHOD OF MAKING SAME

This is a continuation of application Ser. No. 747,957 filed Dec. 6, 1976, now abandoned.

This invention relates in general to new and useful improvements in clothing, and more particularly to the provision of required stiffness to clothing parts, most particularly collars and cuffs of shirts, blouses, etc.

With particular reference to shirt collars, at the present time there is utilized in each collar tip a separately formed elongated plastic strip to effect the stiffening of the collar tip. The plastic reinforcing strip is made by manufacturers other than the clothing manufacturer and must be purchased in quantity and an inventory thereof maintained. Further, it is necessary that some means be provided for maintaining the position of the reinforcing strip within the collar, such as by forming a pocket, or stitching or bonding the plastic strip to the collar.

It will be readily apparent from the foregoing that the provision of a separately formed stiffener or reinforcement is undesirable both from the standpoint of supply and the standpoint of incorporating the stiffener by reinforcement within the clothing part.

In accordance with this invention, it is proposed to apply the necessary stiffening material directly to a component of the clothing part. For example, with respect to a collar or cuff, the usually provided lining may have the reinforcing or stiffening material applied directly thereto in the form of a hot melt plastics material. The plastics material will be applied to the collar or cuff lining in a preselected pattern in accordance with the stiffening desired, both as to thickness and pattern.

It is also feasible to apply the thermoplastics material directly to the backing of a clothing part in certain instances when normally no lining is provided in that clothing part.

In accordance with this invention, with particular reference to the formation of a collar, the collar lining will be formed in the normal manner and in the normal routine of supply. The formed collar lining will then be passed to a machine wherein the desired reinforcing material is applied thereto and thereafter the collar lining is either ready for immediate use or for storage. In accordance with this invention, no inventory of separate stiffening means is required and the clothing component which is to be reinforced will be prepared in the normal manner of supply and will be reinforced in a timely manner so as to eliminate the need for inventory other than that which is normal.

In accordance with this invention, the clothing component which is to be reinforced is presented to a machine which will supply thermoplastics material as a hot melt in a preselected pattern. As soon as the thermoplastics material is applied to the clothing component, the clothing component may be removed from the machine and processed in the usual manner.

With the above and other objects in view that will hereinafter appear, the nature of the invention will be more clearly understood by reference to the following detailed description, the appended claimed subject matter, and the several views illustrated in the accompanying drawing.

IN THE DRAWING:

FIG. 1 is a schematic view showing the general supply trend of a collar lining formed in accordance with this invention including the incorporation thereof within a collar.

FIG. 2 is an enlarged fragmentary plan view showing the reinforced collar lining positioned with respect other collar components ready to be incorporated therein.

FIG. 3A is a fragmentary transverse sectional view on an enlarged scale taken along line 3A—3A of FIG. 2 and shows the application of the thermoplastics reinforcing material to the collar lining.

FIG. 3B is a view similar to FIG. 3A, but shows a variation in thickness of the thermoplastics material.

FIG. 4 is a fragmentary plan view of one quarter of a collar lining having a modified pattern of thermoplastics material applied thereto.

Referring now to the drawings in detail, it will be seen that there is illustrated in FIG. 1 the general method followed in the processing of a liner for a collar in accordance with this invention. A collar liner, generally identified by the numeral 5, is formed in a conventional manner by means of a mechanism generally identified by the numeral 6. Inasmuch as the mechanism 6 in no way plays any part in this invention, no description will be made thereof here.

The formed collar lining is then directed to an applicator, generally identified by the numeral 7 for applying to the opposite tips of the collar liner stiffening or reinforcing material 8 in a preselected pattern. The applicator 7 is a conventional machine produced by USM Corporation and would be modified to incorporate dies 9 in accordance with the desired pattern of the stiffening or reinforcing material 8. Although a dual head machine has been illustrated, it is to be understood that a single machine can be used.

At this time it is pointed out that the stiffening or reinforcing material 8 is a thermoplastics material which will adhere to the material of the collar lining 5 upon application. The thermoplastics material will be applied as a hot melt and may be varied as to composition in accordance with the quality of the product and the stiffness required.

It is to be understood that the reinforced or stiffened collar lining 5 may either then be directly transmitted to the person forming collars or may be placed in supply as is customary with the particular clothing manufacturer. The stiffened collar lining may then be incorporated in a collar in the conventional manner between a facing layer 10 and a backing layer 11.

Referring now to FIG. 2 in particular, it will be seen that the pattern of the stiffening or reinforcing material 8 will be such so as to provide for the desired stiffening of the tip of the collar. The pattern of the material 8, of course, will be predetermined so that when the lining 5 is incorporated within the collar, the material 8 will be properly positioned with respect thereto.

At this time it is pointed out that while the invention has been specifically described in conjunction with a collar lining, it is possible in certain grades of clothing to apply the stiffening or reinforcing material 8 directly to the backing layer 11 so as to eliminate the need for a separate lining. Also, while the invention has been specifically described in conjunction with the stiffening of the tips of a collar, it is to be understood that the stiffening of the clothing may vary in accordance with the requirements of the particular article of clothing and that the stiffening is not limited to the collar, but may be incorporated in the cuffs or other portions of the article of clothing. It is to be noted, however, that the thermoplastics material which is utilized in the forming of the stiffening or reinforcing material 8 will be one wherein the article of clothing may be cleansed in the conventional manner, either by washing or dry cleaning.

Reference is now made to FIGS. 3A and 3B wherein it is shown that the thickness of the stiffening or reinforcing material 8 may be varied. It is to be understood that depending upon material, usage, etc., the material 8 may be of different thicknesses so as to provide for different stiffnesses.

Reference is now made to FIG. 4 wherein there is illustrated a minor modification of the invention. Most specifically, instead of the material 8 being applied as an overall pattern, in order that the desired stiffness of the collar may be obtained and at the same time the collar may be flexible in a direction transverse to the stiffening direction, in lieu of an overall pattern of the material 8, the stiffening or reinforcing material may be applied in the form of stripes 12 so that a certain folding or bending of the collar between the adjacent stripes 12 may occur.

It is to be understood that this invention is not to be limited as to the specific configuration of the stiffening or reinforcing material and other patterns may be developed through usage.

It is particularly pointed out here that the thermoplastics material must be self-bonding to the cloth or other clothing material utilized so that there is a direct application of the thermoplastics material to the clothing component by the applicator 7 and no further process step is required.

Although only a preferred embodiment of the invention and the manner of making the same has been specifically illustrated and described herein, it is to be understood that minor variations may be made in the invention without departing from the spirit and scope of the invention, as defined by the appended claims.

I claim:

1. A method of reinforcing an article of clothing such as a shirt collar and cuffs, said method comprising the steps of forming a clothing component in a customary manner, applying a reinforcing coating of heated thermoplastics material to the formed clothing component in a definite preselected pattern to accomplish the desired reinforcement, then incorporating the clothing component with another clothing component in the making of an article, and the thermoplastics material being self-bonding to the first-mentioned and another clothing component.

2. The method of claim 1 wherein said thermoplastics material is applied as a hot melt.

3. The method of claim 1 wherein the clothing component is a liner for a collar and has a tip, and said pattern is generally triangular in outline.

4. A reinforced clothing component comprising a conventional clothing component customarily incorporated with other clothing components to form a flexible article of clothing and wherein a separate reinforcement member is normally associated with said conventional clothing components, said conventional clothing component being improved by having adhered thereto a reinforcement in the form of a solid layer of reinforcing thermoplastics material applied thereto as a coating in a definite preselected reinforcing pattern with the thermoplastics material being self-bonding to said conventional clothing component.

5. The reinforced clothing component of claim 4 wherein said reinforced clothing component is a liner of the type used in formation of a collar for a shirt and the like.

6. The reinforced clothing component of claim 5 wherein said pattern is generally triangular.

7. The reinforced clothing component of claim 4 wherein the thermoplastics material is applied in stripes to provide for stiffness primarily in one direction.

8. The reinforced clothing component of claim 4 wherein said thermoplastics material is self-bonded to said clothing component.

9. The reinforced clothing component of claim 4 wherein said thermoplastics material is self-bonded to said clothing component and is a hot melt adhesive material.

* * * * *